US005711707A

United States Patent [19]

Zoccole et al.

[11] Patent Number: 5,711,707

[45] Date of Patent: Jan. 27, 1998

[54] METHOD AND DEVICE FOR SIGNALLING THE WINNING OF A BINGO GAME

[76] Inventors: Pasquale Zoccole; Nancy J. Zoccole, both of 5300 Quail Rise St., Las Vegas, Nev. 89130

[21] Appl. No.: 566,435

[22] Filed: Nov. 30, 1995

[51] Int. Cl.[6] ..... G09F 21/02; A63B 71/06

[52] U.S. Cl. ..... 463/35; 273/269

[58] Field of Search ..... 463/1, 16–19, 463/30, 36, 40, 42; 364/410–412; 273/237, 269; 340/321, 323 R

[56] References Cited

U.S. PATENT DOCUMENTS

| | | | |
|---|---|---|---|
| 2,415,991 | 2/1947 | Christian . | |
| 2,563,693 | 8/1951 | Russell . | |
| 4,312,511 | 1/1982 | Jullien | 273/269 |
| 4,378,940 | 4/1983 | Gluz et al. | 273/237 |
| 4,455,025 | 6/1984 | Itkis | 273/237 |
| 4,475,157 | 10/1984 | Bolan | 273/237 |
| 4,572,510 | 2/1986 | Green . | |
| 4,624,462 | 11/1986 | Itkis | 273/269 |
| 4,810,996 | 3/1989 | Glen et al. . | |
| 5,067,895 | 11/1991 | Chuang et al. . | |
| 5,096,202 | 3/1992 | Hesland | 273/237 |
| 5,124,683 | 6/1992 | Brunner . | |
| 5,242,163 | 9/1993 | Fulton | 463/13 |
| 5,251,897 | 10/1993 | Fulton | 463/13 |
| 5,609,337 | 3/1997 | Clapper, Jr. | 463/16 |

*Primary Examiner*—Jessica Harrison
*Assistant Examiner*—Mark A. Sager
*Attorney, Agent, or Firm*—Everett G. Diederiks, Jr.

[57] ABSTRACT

A device for signalling the winning of a bingo game includes a housing within which is contained a control unit including a voice chip, an amplified speaker system, a light indicator and a activation button. In the preferred embodiment of the invention, the device is self-contained and compact so as to present a readily portable item that is provided with an internal power source connected to the control unit through an ON/OFF switch. In use, when a user of the device wins a bingo game, the activation button is used to signal the control unit. The control unit initially, automatically produces an audible "BINGO" call indicating the win through the voice chip, amplifier and speaker. The control unit then provides a continuous visual signal through the light indicator to aid game representatives to readily locate the winning player.

7 Claims, 1 Drawing Sheet

METHOD AND DEVICE FOR SIGNALLING THE WINNING OF A BINGO GAME

BACKGROUND OF THE INVENTION

1. Field of the Invention

The present invention pertains to the art of signalling devices and, more particularly, a device for both audibly and visually signalling the winning of a bingo game, as well as a method of signalling the same.

2. Discussion of the Prior Art

The game of bingo has been and continues to be a form of entertainment enjoyed by many. This fact has lead to such games being played in increasing larger places to accommodate the growing number of participants. Unfortunately, although the caller of such games is generally provided with a microphone in order to be adequately heard, winning participants can have a difficult time adequately signalling the winning of a particular round of the game.

This fact is particularly evident with the elderly who represent a significant percentage of the overall bingo playing population. If played in a large room such as an auditorium, some people may not be able to easily signal the winning of a game perhaps due to the person's inability to sufficiently vocalize the win or for other reasons such as a physical ailment. In addition, even though an initial, recognizable signal may be made, the winning player must continue to signal the win until a representative locates the person to verify the win. This additional signalling may represent further difficulties for the winning player as well.

Therefore, there is a need for a device that can be used to provide a signal of the winning of a bingo game. More particularly, there is a need for a device to both audibly and visually signal a win automatically, instead of the winning player, upon receiving an activation signal from the winning player.

SUMMARY OF THE INVENTION

The invention concerns a method and device for signalling the winning of a bingo game. The device comprises a housing within which is contained a control unit including a voice chip, an amplified speaker system, a light indicator and a activation button. In the preferred embodiment of the invention, the device is self-contained and compact so as to present a readily portable item. In this embodiment, the device is further provided with an internal power source connected to the control unit through an ON/OFF switch.

In use, when a user of the device wins a bingo game, the activation button is depressed to signal the control unit. The control unit then automatically causes an audible "BINGO" signal indicating the win through the voice chip, amplifier and speaker. The control unit further provides a continuous visual signal through the light indicator to aid game representatives to readily locate the winning player.

Additional features and advantages of the present invention will become more readily apparent from the following detailed description of the preferred embodiment thereof when taken in conjunction with the drawings wherein like reference numerals refer to corresponding parts.

DETAILED DESCRIPTION OF THE PREFERRED EMBODIMENT

Figure 1:
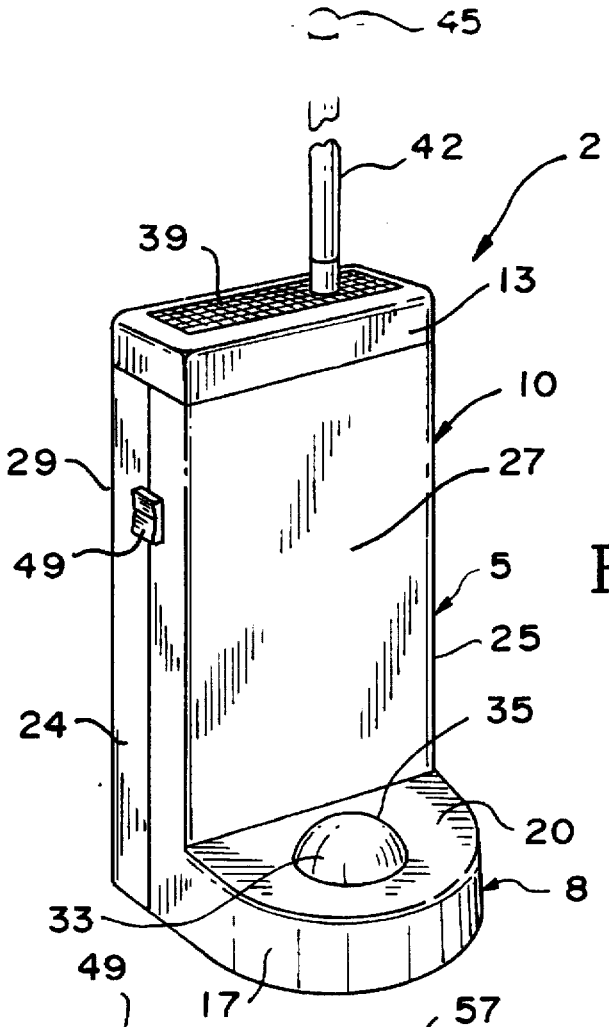
FIG. 1 is a perspective view of a preferred embodiment of the bingo signalling device of the invention.

With initial reference to FIG. 1, the signalling device of the invention is generally indicated at 2 and includes a housing having a base portion 8, an upstanding portion 10 and a cap member 13. Base portion 8, as illustrated, includes an arcuate front wall 17 and defines a plateau portion 20. Front wall 17 extends back to side walls 24 and 25 of upstanding portion 10. Upstanding portion 10 further includes a front upstanding wall 27 that extends upwardly from plateau portion 20 and a rear upstanding wall 29.

In the preferred embodiment, housing 5 is molded of plastic with base portion 8 and a forward half of upstanding portion 10 being integrally formed and a rearward half being interfitted with the forward half. Cap member 13 extends over and joins together the forward and rearward halves of housing 5 and additional fasteners, such as an adhesive or screws (not shown), are further used to assemble housing 5. With this construction, housing 5 is generally hollow and therefore can enclose various other components of signalling device 2 as will be more fully discussed below.

Projecting upward from plateau portion 20 is an activation button 33. In the preferred embodiment, button 33 has a convex outer surface 35 that can be readily, manually engaged and depressed to activate signalling device 2 in the manner which will be detailed below with particular reference to FIG. 2. At this point, it should be noted that locating button 33 on plateau portion 20 is extremely advantageous since even an extremely forceful depression of button 33 will still permit housing 5 to remain in a stable, upright position given the overall configuration of housing 5.

Atop upstanding portion 10 and surrounded by cap member 13 is a speaker grill 39. As will be discussed more fully below, grill 39 covers a speaker used to signal the winning of a bingo game in accordance with the invention. As also shown in FIG. 1, attached to housing 5 and extending substantially vertically therefrom is an elongated extension member 42 that has mounted to an end thereof a visual indicator 45. Visual indicator 45 is also used in accordance with the present invention to signal the winning of a bingo game and preferably constitutes an electric light bulb. Finally, attached at side wall 24 of upstanding portion 10 is an ON/OFF switch for signalling device 2.

Figure 2:
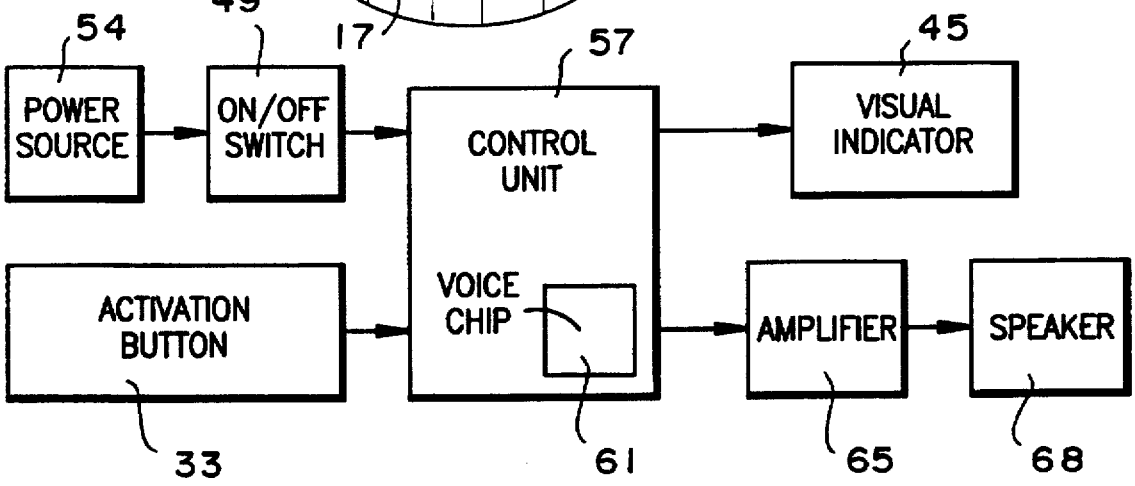
FIG. 2 is a schematic diagram illustrating the control system utilized in the preferred embodiment of FIG. 1.

As indicated above, signalling device 5 includes a control arrangement for automatically signalling the winning of a bingo game upon the depression of button 33. This control arrangement is schematically shown in FIG. 2 and will now be described in detail. ON/OFF switch 49 is electrically interconnected between a power source 54, which could stem from a conventional electrical outlet through a suitable plug and cord or, in the preferred embodiment, constitutes a battery located within housing 5, and a control unit 57. Control unit 57 incorporates a voice chip 61 that has stored therein a predetermined verbal "BINGO" call. The output of voice chip 61 leads to an amplifier 65 and then to a speaker 68 that is located beneath grill 39. Control unit 57 also has an output leading to light indicator 45 and is adapted to receive an activation signal from a user of signalling device 2 through activation button 33 as indicated.

In use, a bingo player would place signalling device 2, which would be turned on through ON/OFF switch 49, within arms reach and upon winning a game would depress button 33. The depression of button 33 would send a signal to control unit 57. In turn, control unit 57 would automatically activate voice chip 61 which would result in an audible "BINGO" call through amplifier 65 and speaker 68 in order to initially signal the bingo caller that the game has been won. Control unit 57 would also automatically activate visual indicator 45 in order to continue to signal the winning of the bingo game and to aid in locating the winning player. In the preferred embodiment, visual indicator 45 blinks and continues to do so until signalling device 2 is reset such as by turning the device off and then on again through ON/OFF switch 49. Of course, if the winning player is not easily located by a game representative, button 33 can again be depressed so that another "BINGO" call is outputted.

From the above description, it should be readily apparent that signalling device 2 represents a compact, readily portable and self-contained unit that can greatly aid many bingo players in adequately signalling the winning of a game without presenting any undo vocal or physical strain on the player. Instead, the simple depression of button 33 or other suitable activation member is all that is required of the player and the internal control arrangement will automatically provide an initial audio signal and a continuing visual signal for drawing attention to the winning player.

Although described with respect to a preferred embodiment of the invention, it should be readily understood that various changes and/or modifications can be made to the signalling device of the invention without departing from the spirit of the invention. For example, extension member 42 may itself be an illuminating rod so as to constitute the visual indicator of signalling device 2. In general, the invention is only intended to be limited by the scope of the following claims.

I claim:

1. A device for use by a bingo player in signalling bingo personnel when a bingo game has been won comprising:

a housing;

means for a bingo player to signal the winning of a game of bingo to bingo personnel, said signal means including both an audible signalling unit having a stored, verbal bingo call and a visual signalling unit, said signal means being mounted, at least partially, within said housing; and means for controlling said signal means to initially activate at least the audible signalling unit an then to enable continues activation of the visual signalling unit, said controlling means including a manual activation member exposed outside of said housing.

2. The bingo signalling device as claimed in claim 1, wherein the audible signalling unit of said signal means comprises a speaker for outputting the stored, verbal bingo call through said speaker upon activation of said controlling means.

3. The bingo signalling device as claimed in claim 2, wherein the visual signalling unit of said means includes a light mounted to said housing.

4. The bingo signalling device as claimed in claim 3, wherein said housing includes a plateau portion that portion that projects forward of a remainder of the housing, said manual activation member being located on said plateau portion.

5. A bingo signalling device comprising:

a housing;

means for a bingo player to signal, both audibly and visually, the winning of a game of bingo to bingo personnel, said signal means being mounted, at least partially, within said housing;

means for controlling said signal means, said controlling means including a portion exposed outside of said housing, wherein said signal means includes a speaker, means for outputting a stored, verbal bingo call through said speaker upon activation of said controlling means, and a light mounted to said housing; and an elongated extension mounted to and projecting from an upper portion of said housing, said light being located on said extension.

6. The bingo signalling device as claimed in claim 5, wherein said device is readily portable.

7. A method of signalling the winning of a bingo game to bingo personnel by a bingo player comprising:

providing a signal to a control assembly, through manual actuation of an activation member mounted to and exposed outside a housing, that a bingo game has been won;

initially, automatically signalling the winning of the bingo game through an audible, bingo call announcement; and continuing to signal the winning of the bingo game through a visual indicator projecting above the housing.

* * * * *